US011228127B2

(12) United States Patent
Shirai et al.

(10) Patent No.: US 11,228,127 B2
(45) Date of Patent: Jan. 18, 2022

(54) ELECTRICAL CONTACT MATERIAL, TERMINAL FITTING, CONNECTOR, WIRE HARNESS, AND ELECTRICAL CONTACT MATERIAL MANUFACTURING METHOD

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Yoshimasa Shirai, Yokkaichi (JP); Yasushi Saito, Yokkaichi (JP); Kingo Furukawa, Yokkaichi (JP); Mitsuhiro Kumondai, Yokkaichi (JP); Akihisa Hosoe, Osaka (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/897,356

(22) Filed: Jun. 10, 2020

(65) Prior Publication Data

US 2020/0412044 A1 Dec. 31, 2020

(30) Foreign Application Priority Data

Jun. 27, 2019 (JP) ..... JP2019-119508

(51) Int. Cl.
*H01R 13/03* (2006.01)
*H01R 43/16* (2006.01)
(Continued)

(52) U.S. Cl.
CPC ..... *H01R 13/03* (2013.01); *H01R 43/16* (2013.01); *H01R 4/185* (2013.01); *H01R 13/11* (2013.01)

(58) Field of Classification Search
CPC ..... H01R 13/03; H01R 13/11; H01R 43/16; H01R 4/185
(Continued)

(56) References Cited

U.S. PATENT DOCUMENTS 5,780,172 A * 7/1998 Fister ..... B32B 15/01 428/647
5,849,424 A * 12/1998 Sugawara ..... C25D 5/505 428/674
(Continued)

FOREIGN PATENT DOCUMENTS

JP 2015-67861 A 4/2015
WO WO-2016031676 A1 * 3/2016 ..... C25D 7/00

*Primary Examiner* — Peter G Leigh
(74) *Attorney, Agent, or Firm* — Oliff PLC

(57) ABSTRACT

Provided is an electrical contact material that can suppress an increase in contact resistance even if contact pressure with a counterpart material is small. An electrical contact material that includes a base material made of metal, a metal layer provided on a surface of the base material, and an oxide layer provided on a surface of the metal layer. The metal layer is made of metal that contains zinc, copper, and tin, the oxide layer is made of an oxide that contains zinc, copper, and tin, and beneath the oxide layer, a ratio of the atomic concentration of copper to the atomic concentration of tin is less than 1.4.

10 Claims, 3 Drawing Sheets

(51) Int. Cl.
*H01R 4/18* (2006.01)
*H01R 13/11* (2006.01)

(58) Field of Classification Search
USPC ..... 439/886
See application file for complete search history.

(56) References Cited

U.S. PATENT DOCUMENTS

| | | | | |
|---|---|---|---|---|
| 8,403,714 | B2 * | 3/2013 | Nakata | H01R 13/03 439/886 |
| 9,966,163 | B2 * | 5/2018 | Sawada | C25D 3/30 |
| 2003/0186597 | A1 * | 10/2003 | Suzuki | H01R 13/03 439/886 |
| 2005/0037229 | A1 * | 2/2005 | Tanaka | C23C 28/021 428/647 |
| 2016/0247592 | A1 | 8/2016 | Sawada | |
| 2019/0161866 | A1 * | 5/2019 | Kubota | C25D 7/00 |

* cited by examiner

ELECTRICAL CONTACT MATERIAL, TERMINAL FITTING, CONNECTOR, WIRE HARNESS, AND ELECTRICAL CONTACT MATERIAL MANUFACTURING METHOD

TECHNICAL FIELD

The present disclosure relates to an electrical contact material, a terminal fitting, a connector, a wire harness, and an electrical contact material manufacturing method.

BACKGROUND ART

Patent Literature 1 discloses an electrical contact material for a connector that includes a base material made of a metal material, an alloy layer formed on the base material, and an electrically-conductive film layer formed on a surface of the alloy layer. The alloy layer contains Sn and Cu as essential elements, and one or more types of additive elements (M) selected from a group consisting of Zn, Co, Ni, and Pd. The alloy layer also contains an intermetallic compound denoted by $(Cu, M)_6Sn_5$, which is obtained by substituting Cu of an intermetallic compound denoted by $Cu_6Sn_5$ with the above-described additive element (M). The electrically-conductive film layer is an oxide layer obtained due to oxidation of the constituent elements of the alloy layer.

CITATION LIST

Patent Literature

Patent Literature 1: JP 2015-67861A

SUMMARY OF INVENTION

Technical Problem

The oxide layer formed on the outermost surface of the electrical contact material may increase contact resistance. However, this oxide layer is likely to break under a load when the electrical contact material in use is fitted to a counterpart material. The breaking of the oxide layer can suppress an increase in the contact resistance of the electrical contact material, so that a favorable electrical connection between the electrical contact material and the counterpart material can easily be ensured via the alloy layer. The reason why the electrical connection can be ensured is that the counterpart material can come into contact with a new surface of the electrical contact material that is exposed from the broken oxide layer.

There is a demand for an electrical contact material that can ensure a favorable electrical connection to a counterpart material, even if the contact pressure with the counterpart material is low and a load applied to the electrical contact material in use is small. For example, if a connector employs a smaller terminal fitting than conventional ones, the contact pressure with the counterpart material will be low, and the load that is applied to the electrical contact material in use will also be small. With a small load applied to the electrical contact material, the oxide layer is not likely to break, leading to an increase in contact resistance, and thus it is difficult to ensure a favorable electrical connection to the counterpart material.

Therefore, it is an object of the present disclosure to provide an electrical contact material that can suppress an increase in contact resistance even if contact pressure with a counterpart material is low. It is another object of the present disclosure to provide a terminal fitting made of the aforementioned electrical contact material, a connector provided with the aforementioned terminal fitting, and a wire harness provided with the aforementioned terminal fitting or connector. It is yet another object of the present disclosure to provide an electrical contact material manufacturing method in which it is possible to easily obtain an electrical contact material that can suppress an increase in contact resistance even if contact pressure with a counterpart material is low.

Solution to Problem

According to the present disclosure, an electrical contact material includes:

a base material made of metal;

a metal layer provided on a surface of the base material; and an oxide layer provided on a surface of the metal layer, wherein the metal layer is made of metal that contains zinc, copper, and tin, the oxide layer is made of an oxide that contains zinc, copper, and tin, and beneath the oxide layer, a ratio of the atomic concentration of copper to the atomic concentration of tin is less than 1.4.

According to the present disclosure, a terminal fitting is made of the electrical contact material of the present disclosure.

According to the present disclosure, a connector includes the terminal fitting of the present disclosure.

According to the present disclosure, a wire harness includes:

an electrical wire; and the terminal fitting of the present disclosure or the connector of the present disclosure that is attached to the electrical wire.

According to the present disclosure, an electrical contact material manufacturing method includes:

a step of manufacturing a coated material by plating a first layer, a second layer, and a third layer on at least a part of a surface of a base material in the order from the surface of the base material; and a step of subjecting the coated material to thermal treatment under oxygen atmosphere at a temperature of 232° C. to 500° C. inclusive, wherein, in the step of manufacturing the coated material, the first layer is made of metal that contains tin, the second layer is made of metal that contains zinc, the third layer is made of metal that contains copper, the first layer has a thickness of 3.5 μm to 5 μm inclusive, the second layer has a thickness of 0.1 μm to 0.6 μm inclusive, and the third layer has a thickness of 0.05 μm to 0.4 μm inclusive.

Advantageous Effects of Invention

With the electrical contact material according to the present disclosure, it is possible to suppress an increase in contact resistance even if contact pressure with a counterpart material is low. Furthermore, with the terminal fitting, the connector, and the wire harness according to the present disclosure, it is possible to suppress an increase in contact resistance even if contact pressure with a counterpart material is low. Moreover, with the electrical contact material manufacturing method according to the present disclosure, it is possible to easily obtain an electrical contact material that can suppress an increase in contact resistance even if contact pressure with a counterpart material is low.

DESCRIPTION OF EMBODIMENT

Description of Embodiment of Present Disclosure

Figure 1:
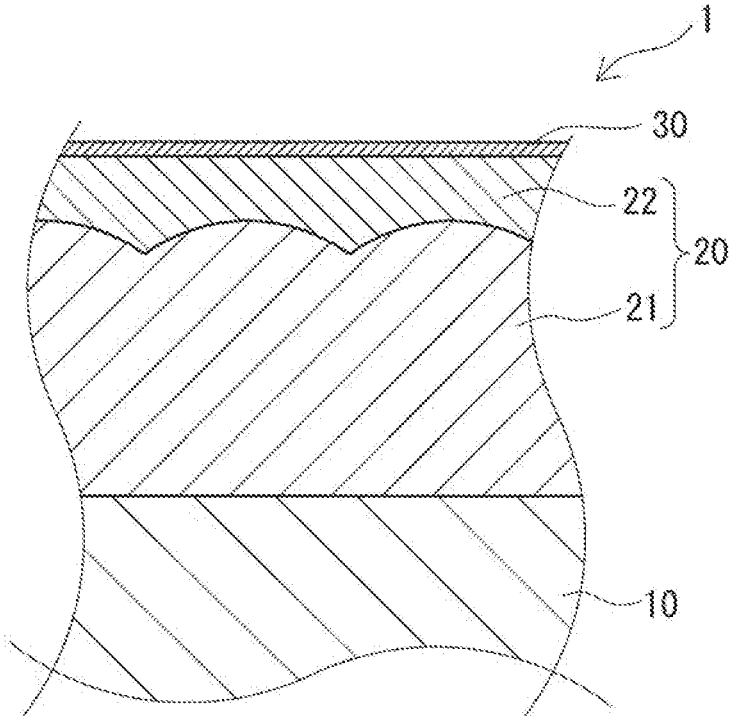
FIG. 1 is a diagram schematically illustrating a configuration of an electrical contact material according to an embodiment.

First, the content of an embodiment according to the present disclosure will be described in order.

(1) An electrical contact material according to the embodiment of the present disclosure includes:

a base material made of metal;

a metal layer provided on a surface of the base material; and an oxide layer provided on a surface of the metal layer, wherein the metal layer is made of metal that contains zinc, copper, and tin, the oxide layer is made of an oxide that contains zinc, copper, and tin, and beneath the oxide layer, a ratio of the atomic concentration of copper to the atomic concentration of tin is less than 1.4.

Since the electrical contact material according to the present disclosure satisfies the condition that, beneath the oxide layer, the ratio of the atomic concentration of copper to the atomic concentration of tin is less than 1.4, a copper oxide is not likely to be formed in the oxide layer. Hereinafter, the above-described ratio is also referred to as "atomic concentration ratio Cu/Sn". The oxide layer with a small amount of copper oxide has a low resistivity, and can easily ensure the electrical conductivity. Accordingly, the electrical contact material of the present disclosure can ensure a favorable electrical connection to a counterpart material even if there is an oxide layer on the surface of the metal layer. Therefore, the electrical contact material of the present disclosure can suppress an increase in contact resistance even if contact pressure with a counterpart material is small.

(2) As an example of the electrical contact material according to the present disclosure, a configuration may be such that, in the oxide layer, the atomic concentration of oxygen is more than 0 atom % and is equal to or less than 70 atom %, the atomic concentration of zinc is more than 0 atom % and is equal to or less than 70 atom %, the atomic concentration of copper is more than 0 atom % and is equal to or less than 30 atom %, and the atomic concentration of tin is more than 0 atom % and is equal to or less than 30 atom %.

The oxide layer that satisfies the above-described atomic concentrations is likely to have an improved conductivity. Accordingly, the electrical contact material including the oxide layer that satisfies the above-described atomic concentrations can ensure a more favorable electrical connection to a counterpart material even if there is the oxide layer on the surface of the metal layer. Furthermore, the electrical contact material including the oxide layer that satisfies the above-described atomic concentrations can easily suppress the oxidation of the base material, and can easily ensure stable durability.

(3) As an example of the electrical contact material according to the present disclosure, a configuration may be such that, the oxide layer has an average thickness of 1 nm to 1000 nm inclusive.

Since the oxide layer has an average thickness of 1 nm or greater, a total thickness of the metal layer and the oxide layer with which the surface of the base material is coated can be thick, making it easy to suppress the oxidation of the base material. On the other hand, since the oxide layer has an average thickness of 1000 nm or smaller, the oxide layer is likely to have a low resistance. With the oxide layer having a low resistance, the electrical contact material according to the present disclosure can ensure a more favorable electrical connection to a counterpart material even if there is an oxide layer on the surface of the metal layer.

(4) As an example of the electrical contact material according to the present disclosure, a configuration may be such that, the metal layer includes:

a first metal layer provided on the base material side; and a second metal layer provided on the oxide layer side, and the first metal layer is made of an alloy that contains two or more types of elements selected from a group consisting of zinc, copper, and tin, and the second metal layer is made of tin or a tin alloy.

Since the second metal layer is provided on the oxide layer side of the metal layer, it is easy to suppress copper contained in the metal layer from diffusing toward the oxide layer. Since it is possible to suppress the diffusion of copper toward the oxide layer, the condition that the atomic concentration ratio Cu/Sn beneath the oxide layer is less than 1.4 is likely to be satisfied. Accordingly, a copper oxide is very unlikely to be formed in the oxide layer. With the oxide layer provided with a smaller amount of copper oxide, the electrical contact material of the present disclosure can ensure a more favorable electrical connection to a counterpart material even if there is an oxide layer on the surface of the metal layer.

(5) As an example of the electrical contact material according to the present disclosure, a configuration may be such that the first metal layer has an average thickness of 0.1 μm to 5 μm inclusive.

Since the first metal layer has an average thickness of 0.1 μm or greater, the metal layer can have a large thickness, making it easy to suppress the oxidation of the base material. On the other hand, since the first metal layer has an average thickness of 5 μm or smaller, it is possible to suppress the metal layer from being too thick. Furthermore, since the first metal layer has an average thickness of 5 μm or smaller, it is possible to avoid taking long time to form the metal layer.

(6) As an example of the electrical contact material according to the present disclosure, a configuration may be such that the second metal layer has an average thickness of 0.1 μm to 5 μm inclusive.

Since the second metal layer has an average thickness of 0.1 μm or greater, the metal layer can have a large thickness, making it easy to suppress the oxidation of the base material. Furthermore, since the second metal layer has an average thickness of 0.1 μm or greater, it is easier to suppress copper contained in the metal layer from diffusing toward the oxide layer. Since it is possible to suppress the diffusion of copper toward the oxide layer, the condition that the atomic concentration ratio Cu/Sn beneath the oxide layer is less than 1.4 is likely to be satisfied. Accordingly, a copper oxide is very unlikely to be formed in the oxide layer. On the other hand, since the second metal layer has an average thickness of 5 μm or smaller, it is possible to suppress the metal layer from being too thick. Furthermore, since the second metal layer has an average thickness of 5 μm or smaller, it is possible to avoid taking long time to form the metal layer.

(7) A terminal fitting according to the embodiment of the present disclosure is made of the electrical contact material according to any one of the above-described items (1) to (6).

Since the terminal fitting according to the present disclosure is made of the electrical contact material according to the present disclosure, it is possible to suppress an increase in contact resistance even if contact pressure with a counterpart material is small.

(8) A connector according to the embodiment of the present disclosure includes the terminal fitting according to the above-described item (7).

Since the connector according to the present disclosure includes the terminal fitting of the present disclosure, it is possible to suppress an increase in contact resistance even if contact pressure with a counterpart material is small.

(9) A wire harness according to the embodiment of the present disclosure includes:

an electrical wire; and the terminal fitting according to above-described item (7) or the connector according to above-described item (8), the terminal fitting or the connector being attached to the electrical wire.

Since the wire harness according to the present disclosure includes the terminal fitting of the present disclosure or the connector of the present disclosure, it is possible to suppress an increase in contact resistance even if contact pressure with a counterpart material is small.

(10) An electrical contact material manufacturing method according to the embodiment of the present disclosure includes:

a step of manufacturing a coated material by plating a first layer, a second layer, and a third layer on at least a part of a surface of a base material in the order from the surface of the base material; and a step of subjecting the coated material to thermal treatment under oxygen atmosphere at a temperature of 232° C. to 500° C. inclusive, wherein, in the step of manufacturing the coated material, the first layer is made of metal that contains tin, the second layer is made of metal that contains zinc, the third layer is made of metal that contains copper, the first layer has a thickness of 3.5 μm to 5 μm inclusive, the second layer has a thickness of 0.1 μm to 0.6 μm inclusive, and the third layer has a thickness of 0.05 μm to 0.4 μm inclusive.

In the electrical contact material manufacturing method according to the present disclosure, the base material is coated, through plating, with the first layer that contains tin, the second layer that contains zinc, and the third layer that contains copper, in the order from the base material side. The coated material obtained by coating the base material with a coating layer including the first layer, the second layer, and the third layer undergoes alloying reaction over time. On the other hand, by subjecting the coated material to thermal treatment, an oxide layer is formed on the surface of the coated material. At this time, since the thicknesses of the respective layers of the coating layer satisfy the above-described ranges, tin is likely to diffuse toward the oxide layer, but copper is not likely to diffuse. Specifically, by performing the thermal treatment at a temperature of 232° C. or higher, it is possible to bring tin into a liquid phase state, so that tin in the first layer having the thickness of the above-described range is likely to diffuse toward the oxide layer. Furthermore, by performing the thermal treatment at a temperature of 232° C. or higher, the oxide layer is likely to contain tin or zinc but is less likely to contain copper. On the other hand, by performing the thermal treatment at a temperature of 500° C. or lower, copper in the third layer having the thickness of the above-described range is not likely to diffuse toward the oxide layer. With the above-described configurations, according to the electrical contact material manufacturing method of the present disclosure, it is possible to form, on the surface of the base material, the metal layer made of an alloy that contains tin, zinc, and copper, and to form, on the surface of this metal layer, an oxide layer made of an oxide that contains tin, zinc, and copper. At this time, since the thicknesses of the respective layers of the coating layer satisfy the above-described ranges, and the thermal treatment is performed at a temperature in the above-described range, the diffusion of tin and copper can be controlled, so that the atomic concentration ratio Cu/Sn beneath the oxide layer is less than 1.4.

Details of Embodiment of Present Disclosure

The embodiment of the present disclosure will be described in detail below. Note that the present invention is defined by the terms of the claims, but not limited to the above description, and is intended to include any modifications within the meaning and scope equivalent to the terms of the claims.

<<Electrical Contact Material>>

As shown in FIG. 1, an electrical contact material 1 according to the embodiment includes a base material 10 made of metal, a metal layer 20 provided on a surface of the base material 10, and an oxide layer 30 provided on a surface of the metal layer 20. The metal layer 20 is made of metal that contains zinc (Zn), copper (Cu), and tin (Sn). The oxide layer 30 is made of an oxide that contains Zn, Cu, and Sn. One of the characteristics of the electrical contact material 1 according to the embodiment is that the ratio of the atomic concentration of Cu to the atomic concentration of Sn beneath the oxide layer 30, that is, the atomic concentration ratio Cu/Sn is less than 1.4.

[Base Material]

The base material 10 is made of metal. Specifically, the base material 10 is preferably made of one or more types of metal selected from a group consisting of Cu, a Cu alloy, aluminum (Al), an Al alloy, iron (Fe), and a Fe alloy, which are superior in terms of electrical conductivity. As the shape of the base material 10, various shapes such as a rod shape and a plate shape can be selected as appropriate. Furthermore, as the size of the base material 10, various dimensions can be selected as appropriate depending on the usage.

The base material 10 may include, on a surface thereof, a plated layer (not shown). The plated layer may include, for example, one or more types of metal selected from a group consisting of Cu, a Cu alloy, nickel (Ni), a Ni alloy, cobalt (Co), and a Co alloy. A plated layer provided on the surface of the base material 10 can improve the adhesion to the metal layer 20 that is provided on the surface of the base material 10. Furthermore, if the base material 10 and the plated layer are made of the same type of metal, the constituent element of the base material 10 can be facilitated to diffuse toward the metal layer 20. For example, if a metal plate containing Cu is provided with, on a surface thereof, a plated layer containing Cu, Cu of the base material 10 can be facilitated to diffuse toward the metal layer 20. The thickness of the plated layer may be from 0.01 to 5 μm inclusive, and preferably from 0.1 to 3 μm inclusive. In this context, the thickness of the plated layer is the thickness of the plated layer when plated on the surface of the base material 10 in the process of manufacturing the electrical contact material 1.

[Metal Layer]

The metal layer 20 has the function of suppressing the oxidation of the base material 10. The metal layer 20 has a composition different from that of the base material 10. The metal layer 20 preferably has a composition that is less likely to become oxidized than the base material 10. In this example, the metal layer 20 has a multi-layer structure with a first metal layer 21 and a second metal layer 22.

(First Metal Layer)

The first metal layer 21 is provided on the base material 10 side of the metal layer 20. The first metal layer 21 is made of an alloy that includes two or more types of elements selected from a group consisting of Zn, Cu, and Sn. The atomic concentrations of the elements of the first metal layer 21 may be such that the atomic concentration of Zn is from 0.01 to 50 atom % inclusive, the atomic concentration of Cu is from 10 to 90 atom % inclusive, and the atomic concentration of Sn is from 10 to 90 atom % inclusive. By satisfying the above-described atomic concentrations, the first metal layer 21 contains an intermetallic compound denoted by $(Cu, Zn)_6Sn_5$, for example. Preferably, the atomic concentrations of the elements of the first metal layer 21 may be such that the atomic concentration of Zn is from 0.1 to 30 atom % inclusive, the atomic concentration of Cu is from 40 to 80 atom % inclusive, and the atomic concentration of Sn is from 20 to 50 atom % inclusive. The atomic concentrations of the elements of the first metal layer 21 can be measured using, for example, an X-ray fluorescence spectrometer. The first metal layer 21 is mainly formed, in the process of manufacturing the electrical contact material 1, due to alloying reaction that occurs over time after the constituent materials of the metal layer 20 have been plated on the surface of the base material 10. That is to say, the first metal layer 21 is formed mainly when the constituent materials of the metal layer 20 that have been plated on the surface of the base material 10 are left and subjected to thermal treatment, in the process of manufacturing the electrical contact material 1.

The first metal layer 21 may have an average thickness of 0.1 to 5 μm inclusive. As a result of the first metal layer 21 having an average thickness of 0.1 μm or greater, the metal layer 20 can have a large thickness, making it easy to suppress the oxidation of the base material 10. On the other hand, as a result of the first metal layer 21 having an average thickness of 5 μm or smaller, it is possible to suppress the metal layer 20 from being too thick. Also, as a result of the first metal layer 21 having an average thickness of 5 μm or smaller, it is possible to avoid taking long time to form the metal layer 20. The average thickness of the first metal layer 21 may be preferably from 0.5 to 4.5 μm inclusive, more preferably from 1.0 to 4.0 μm inclusive, and further preferably from 2.0 to 4.0 μm inclusive. The average thickness of the first metal layer 21 can be measured, for example, using an X-ray fluorescence film thickness meter in the following manner. The oxide layer 30 and the second metal layer 22 provided above the first metal layer 21 are removed. Then, the contents of Sn in specific areas of the first metal layer 21 are measured using the X-ray fluorescence film thickness meter, and the thickness of the first metal layer 21 is calculated based on the composition and density of the first metal layer 21. For example, ten specific areas of the first metal layer 21 are selected, the values of the thickness of the first metal layer 21 calculated for these specific areas are averaged, and this average is regarded as the average thickness of the first metal layer 21.

(Second Metal Layer)

The second metal layer 22 is provided on the oxide layer 30 side of the metal layer 20. The second metal layer 22 is made of Sn or a Sn alloy. The second metal layer 22 is interposed between the first metal layer 21 and the oxide layer 30. The second metal layer 22 is a layer in which the atomic concentration of Cu is sufficiently lower than the atomic concentration of Sn, compared to in the first metal layer 21. If the second metal layer 22 is made of a Sn alloy, and includes Cu serving as an additive element other than Sn, the atomic concentration of Cu may be from 0.01 to 50 atom % inclusive, and preferably from 0.1 to 30 atom % inclusive. Alternatively, if the second metal layer 22 is made of a Sn alloy, and includes Zn serving as an additive element other than Sn, the atomic concentration of Zn may be from 0.01 to 50 atom % inclusive, and preferably from 0.1 to 40 atom % inclusive. The atomic concentrations of the elements of the second metal layer 22 can be measured using, for example, an X-ray fluorescence spectrometer. The second metal layer 22 is formed mainly when, in the process of manufacturing the electrical contact material 1, Sn provided on the surface of the base material 10 enters into a liquid phase state. That is to say, the second metal layer 22 is formed mainly during the thermal treatment that is performed after the constituent materials of the metal layer 20 have been plated on the surface of the base material 10, in the process of manufacturing the electrical contact material 1.

The second metal layer 22 may have an average thickness of 0.1 to 5 μm inclusive. As a result of the second metal layer 22 having an average thickness of 0.1 μm or greater, the metal layer 20 can have a large thickness, making it easy to suppress the oxidation of the base material 10. Furthermore, as a result of the second metal layer 22 having an average thickness of 0.1 μm or greater, it is easy to suppress Cu contained in the first metal layer 21 from diffusing toward the oxide layer 30. Moreover, as a result of the second metal layer 22 having an average thickness of 0.1 μm or greater, when the base material 10 contains Cu, it is also easy to suppress Cu contained in the base material 10 from diffusing toward the oxide layer 30. Since it is possible to suppress the diffusion of Cu toward the oxide layer 30, the condition that the atomic concentration ratio Cu/Sn beneath the oxide layer 30 is less than 1.4 is likely to be satisfied. On the other hand, as a result of the second metal layer 22 having an average thickness of 5 μm or smaller, it is possible to suppress the metal layer 20 from being too thick. Also, as a result of the second metal layer 22 having an average thickness of 5 μm or smaller, it is possible to avoid taking long time to form the metal layer 20. The average thickness of the second metal layer 22 may be preferably from 0.2 to 4.0 μm inclusive, more preferably from 0.3 to 3.0 μm inclusive, and further preferably from 0.3 to 1.0 μm inclusive. The average thickness of the second metal layer 22 can be measured, for example, using an X-ray fluorescence film thickness meter in the following manner. The oxide layer 30 is removed, and the contents of Sn in specific areas of the entire metal layer 20 are measured using the X-ray fluorescence film thickness meter. Then, the second metal layer 22 is removed, and the contents of Sn in the specific area of the remaining first metal layer 21 are measured using the X-ray fluorescence film thickness meter. The removal of the oxide layer 30 and the second metal layer 22 is performed through etching using later-described specific treatment liquid. The thickness of the second metal layer 22 can be calculated based on a difference between the measured contents of Sn in the specific areas of the entire metal layer 20 and the measured contents of Sn in the specific areas of the first metal layer 21. For example, ten specific areas are selected, the values of the thickness of the second metal layer 22 calculated for these specific areas are averaged, and this average is regarded as the average thickness of the second metal layer 22.

[Oxide Layer]

The oxide layer 30 is provided on a surface of the metal layer 20. The oxide layer 30 is formed mainly through oxidation of the constituent elements of the metal layer 20 in the process of manufacturing the electrical contact material 1. The oxide layer 30 configures the outermost surface of the electrical contact material 1.

The oxide layer 30 may be present as a mixture of oxides such as ZnO, SnO, $SnO_2$, CuO, and $CuO_2$, for example. Also, the oxide layer 30 may be present as a chemical compound made of the above-described various types of oxides. ZnO may be present in the form of (Zn, Cu)O or (Zn, Sn)O obtained by substituting part of Zn with Cu or Sn. The oxide layer 30 includes a smaller amount of Cu oxide than those of other oxides, as will be described later. Specifically, the oxide layer 30 includes a smaller amount of Cu oxide than that of Zn oxide. The oxide layer 30 with a smaller amount of Cu oxide can easily ensure the electrical conductivity.

The atomic concentrations of the elements of the oxide layer 30 may be such that the atomic concentration of O is more than 0 atom % and is equal to or less than 70 atom %, the atomic concentration of Zn is more than 0 atom % and is equal to or less than 70 atom %, the atomic concentration of Cu is more than 0 atom % and is equal to or less than 30 atom %, and the atomic concentration of Sn is more than 0 atom % and is equal to or less than 30 atom %. By satisfying the above-described atomic concentrations, the oxide layer 30 is likely to have an improved conductivity. Also, by satisfying the above-described atomic concentrations, the oxide layer 30 is likely to suppress the oxidation of the base material 10. Preferably, the atomic concentrations of the elements of the oxide layer 30 may be such that the atomic concentration of O is from 10 to 60 atom % inclusive, the atomic concentration of Zn is from 10 to 60 atom % inclusive, the atomic concentration of Cu is from 0.1 to 20 atom % inclusive, and the atomic concentration of Sn is from 0.1 to 20 atom % inclusive. More preferably, the atomic concentrations of the elements of the oxide layer 30 may be such that the atomic concentration of O is from 40 to 55 atom % inclusive, the atomic concentration of Zn is from 35 to 60 atom % inclusive, the atomic concentration of Cu is from 5 to 15 atom % inclusive, the atomic concentration of Sn is from 0.1 to 10 atom % inclusive. The atomic concentrations of the elements of the oxide layer 30 can be measured using, for example, X-ray photoelectron spectrometry. The oxide layer 30 is formed mainly through oxidation of the constituent elements of the metal layer 20 provided on the surface of the base material 10, in the process of manufacturing the electrical contact material 1. That is to say, the oxide layer 30 is formed mainly during the thermal treatment that is performed after the constituent materials of the metal layer 20 have been plated on the surface of the base material 10, in the process of manufacturing the electrical contact material 1.

The oxide layer 30 may have an average thickness of 1 to 1000 nm inclusive. Since the oxide layer 30 has an average thickness of 1 nm or greater, a total thickness of the metal layer 20 and the oxide layer 30 with which the surface of the base material 10 is coated can be thick, making it easy to suppress the oxidation of the base material 10. On the other hand, as a result of the oxide layer 30 having an average thickness of 1000 nm or smaller, the oxide layer 30 is likely to have a low resistance. The average thickness of the oxide layer 30 may be preferably from 3 to 500 nm inclusive, more preferably from 10 to 300 nm inclusive, further preferably from 15 to 100 nm inclusive, and further more preferably from 20 to 80 nm inclusive. The average thickness of the oxide layer 30 can be obtained in such a manner that, for example, ten arbitrary measurement points are selected, the thickness of the oxide layer 30 at each of the measurement points is measured using X-ray photoelectron spectrometry, and these measurements are averaged.

[Beneath Oxide Layer]

Beneath the oxide layer 30, the atomic concentration ratio Cu/Sn is less than 1.4. When the atomic concentration ratio Cu/Sn of less than 1.4 is satisfied, Cu present beneath the oxide layer 30 may mainly have the form of $Cu_6Sn_5$. As a result of Cu being present in the form of $Cu_6Sn_5$, a Cu oxide is not likely to be formed in the oxide layer 30. The oxide layer 30 with a smaller amount of Cu oxide can easily ensure the electrical conductivity. Accordingly, even if the oxide layer 30 is present on the outermost surface, the electrical contact material 1 can ensure a favorable electrical connection between the base material 10 and a counterpart material via the electrically-conductive oxide layer 30 and metal layer 20. Note that, if the atomic concentration ratio Cu/Sn is 1.4 or greater, Cu present beneath the oxide layer 30 may mainly have the form of $Cu_3Sn$. If Cu is present in the form of $Cu_3Sn$, a Cu oxide is likely to be formed in the oxide layer 30.

The smaller the atomic concentration ratio Cu/Sn beneath the oxide layer 30 is, the less likely a Cu oxide is to be formed in the oxide layer 30. Accordingly, the atomic concentration ratio Cu/Sn beneath the oxide layer 30 may be 1.3 or less, and preferably 1.2 or less. In this context, "beneath the oxide layer 30" means the range within 0.05 μm from the interface between the oxide layer 30 and the second metal layer 22 to the second metal layer 22 side in terms of sputtering rate of $SiO_2$. The above-described atomic concentration ratio Cu/Sn can be measured using X-ray photoelectron spectrometry.

<<Terminal Fitting, Connector, and Wire Harness>>

Figure 3:
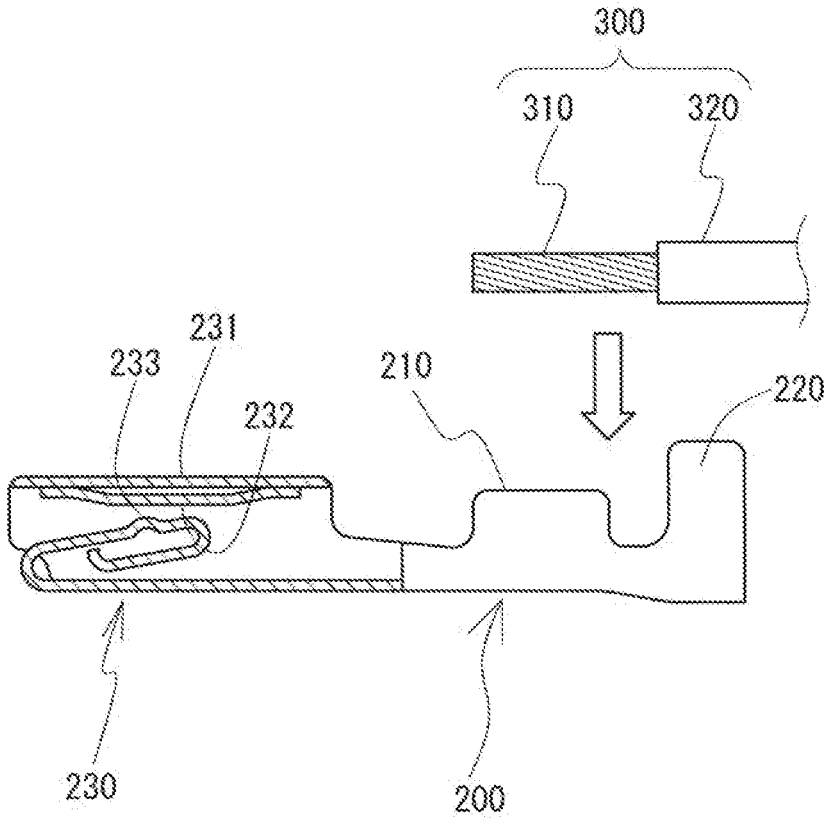
FIG. 3 is a diagram schematically illustrating a configuration of a terminal fitting made of the electrical contact material according to the embodiment.

The electrical contact material 1 is applicable to a terminal fitting, a connector, and a wire harness as appropriate. FIG. 3 shows a female-type terminal fitting 200. This terminal fitting 200 is of a crimp type that includes a wire barrel portion 210 mainly constituted by a pair of crimping pieces, the wire barrel portion 210 serving as a conductor connection portion for connecting a conductor 310 included in an electrical wire 300. The terminal fitting 200 further includes an insulation barrel portion 220 configured to crimp an insulating layer 320 of the electrical wire 300. The terminal fitting 200 includes, on one side of the wire barrel portion 210, a female-type fitting portion 230. The fitting portion 230 includes a tubular box portion 231, and elastic pieces 232 and 233 that are arranged facing the inner surface of the box portion 231. At least one of the elastic pieces 232 and 233 is made of the above-described electrical contact material 1. When a male-type fitting portion (not shown) is inserted into the box portion 231 of the female-type fitting portion 230, the male-type fitting portion is rigidly held by the biasing force of the elastic pieces 232 and 233 of the female-type fitting portion 230, so that the female-type terminal fitting 200 and the male-type terminal fitting are electrically connected to each other. The above-described electrical contact material 1 can suppress an increase in contact resistance even if contact pressure with a counterpart material is small, and thus is applicable to a terminal fitting having small elastic pieces 232 and 233 as appropriate.

<<Method for Manufacturing Electrical Contact Material>>

The electrical contact material manufacturing method according to the present embodiment includes a plating process and a thermal treatment process.

[Plating Process]

Figure 2:
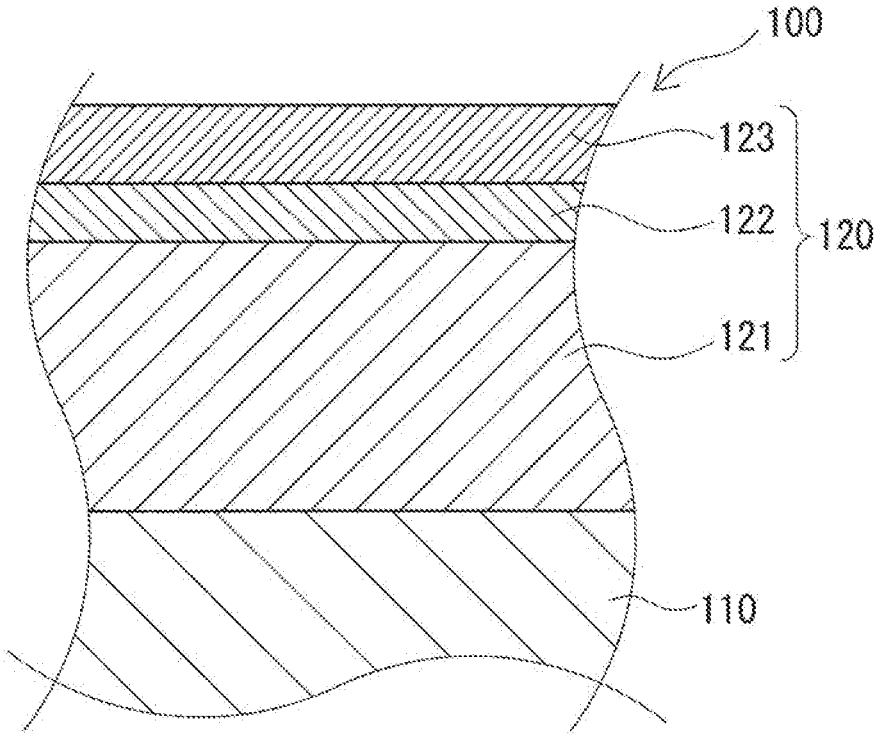
FIG. 2 is a diagram schematically illustrating a configuration of a step for forming a coated material, the step being included in an electrical contact material manufacturing method according to the embodiment.

In the plating process, as shown in FIG. 2, a coated material 100 is formed by coating at least part of the surface of a base material 110 with a coating layer 120 through plating. The base material 110 is the base material 10 of the above-described electrical contact material 1. The coating layer 120 has a multi-layer structure in which a first layer 121 made of metal containing Sn, a second layer 122 made of metal containing Zn, and a third layer 123 made of metal containing Cu are stacked on each other in the order from the base material 110 side. Examples of the plating method include electroplating, non-electrolytic plating, and hot-dip plating.

(First Layer)

The first layer 121 is provided to form the first metal layer 21 and the second metal layer 22 through later-described thermal treatment, and suppress Cu from diffusing toward the oxide layer 30 of the obtained electrical contact material 1. The first layer 121 is made of Sn or a Sn alloy. If the first layer 121 is made of a Sn alloy, Cu or Zn may be contained as an additive element other than Sn. The atomic concentration of the additive element may be from 0.1 to 50 atom % inclusive, and preferably from 1 to 30 atom % inclusive.

The thickness of the first layer 121 largely affects the thickness of the second metal layer 22 of the obtained electrical contact material 1. The thickness of the first layer 121 is set to be from 3.5 to 5 μm inclusive. As a result of the thickness of the first layer 121 being set to 3.5 μm or greater, the second metal layer 22 is likely to have a large average thickness, making it easy to suppress the diffusion of Cu toward the oxide layer 30. On the other hand, as a result of the thickness of the first layer 121 being set to 5 μm or smaller, it is possible to suppress the metal layer 20 from being too thick. Also, as a result of the thickness of the first layer 121 being set to 5 μm or smaller, it is possible to avoid taking long time to form the metal layer 20. The thickness of the first layer 121 may be from 3.5 to 4.5 μm inclusive, and preferably from 3.5 to 4.0 μm inclusive. The thickness of the first layer 121 can be set to a desired thickness based on, for example, a current and duration at the time of plating.

(Second Layer)

If the order of stacking the first layer 121 and the third layer 123 is decided, the second layer 122 will be uniquely determined, and is provided on the surface of the first layer 121. The second layer 122 is made of Zn or a Zn alloy. If the second layer 122 is made of a Zn alloy, Sn may be contained as an additive element other than Zn. The atomic concentration of the additive element may be from 0.1 to 50 atom % inclusive, and preferably from 1 to 30 atom % inclusive.

The thickness of the second layer 122 is set to be from 0.1 to 0.6 μm inclusive. As a result of the thickness of the second layer 122 being set to 0.1 μm or greater, the oxide layer 30 is likely to contain Zn, and the oxidation of the base material 110 is likely to be suppressed. On the other hand, as a result of the thickness of the second layer 122 being set to 0.6 μm or smaller, the oxide layer 30 is likely to contain Sn or Zn but is less likely to contain Cu. The thickness of the second layer 122 may be from 0.2 to 0.5 μm inclusive, and preferably from 0.2 to 0.4 μm inclusive. The thickness of the second layer 122 can be set to a desired thickness based on, for example, a current and duration at the time of plating.

(Third Layer)

The third layer 123 is provided on the surface of the second layer 122 so as to be less likely to oxidize due to the later-described thermal treatment. The constituent elements of the third layer 123 react with the constituent elements of the first layer 121. Due to the reaction, the constituent elements of the base material 110 are assumed to be suppressed from excessively diffusing toward the oxide layer 30 of the obtained electrical contact material 1. The third layer 123 is an outer-most layer of the coating layer 120. The third layer 123 is made of Cu or a Cu alloy. If the third layer 123 is made of a Cu alloy, Sn may be contained as an additive element other than Cu. The atomic concentration of the additive element may be from 0.1 to 50 atom % inclusive, and preferably from 1 to 30 atom % inclusive.

The thickness of the third layer 123 is set to be from 0.05 to 0.4 μm inclusive. As a result of the thickness of the third layer 123 being set to 0.05 μm or greater, it is easy to form the oxide layer 30 and to suppress the oxidation of the base material 110. On the other hand, as a result of the thickness of the third layer 123 being set to 0.4 μm or smaller, the oxide layer 30 is likely to contain Sn or Zn but is less likely to contain Cu. The thickness of the third layer 123 may be from 0.1 to 0.4 μm inclusive, and preferably from 0.2 to 0.4 μm inclusive. The thickness of the third layer 123 can be set to a desired thickness based on, for example, a current and duration at the time of plating.

[Thermal Treatment Process]

After the above-described plating process, in the thermal treatment process, the coated material 100 is subjected to thermal treatment. The thermal treatment is performed under oxygen atmosphere. Furthermore, thermal treatment is performed at a temperature of 232° C. to 500° C. inclusive. As a result of the thermal treatment temperature being 232° C. or higher, Sn is likely to enter into a liquid phase state, the oxide layer 30 is likely to contain Sn or Zn but is less likely to contain Cu. On the other hand, as a result of the thermal treatment temperature being 500° C. or lower, the second metal layer 22 is likely to be formed on the oxide layer 30 side, making it easy to suppress Cu from diffusing toward the oxide layer 30. The second metal layer 22 is such that the atomic concentration of Cu is sufficiently lower than the atomic concentration of the Sn. The thermal treatment temperature may be from 240° C. to 450° C. inclusive, and preferably from 250° C. to 400° C. inclusive. The retention time of the thermal treatment may be from 1 second to 5 minutes inclusive. As a result of the retention time of the thermal treatment being set to be 1 second or longer, Sn can enter into a liquid phase state, and the oxide layer 30 is likely to contain Sn or Zn but is less likely to contain Cu. On the other hand, as a result of the retention time of the thermal treatment being set to be 5 minutes or shorter, the second metal layer 22 is likely to be formed on the oxide layer 30 side, making it easy to suppress Cu from diffusing toward the oxide layer 30. The retention time of the thermal treatment may be preferably from 2 seconds to 4 minutes inclusive, and more preferably from 3 seconds to 3 minutes inclusive.

The thermal treatment may be performed within 14 days after the end of the plating process. In the coated material 100 after having been subjected to plating process, the first layer 121, the second layer 122, and the third layer 123 that constitute the coating layer 120 undergo alloying reaction over time. As a result of the thermal treatment being performed within 14 days after the end of the plating process, the thermal treatment can be performed before alloys are formed between the first layer 121, the second layer 122, and the third layer 123. Accordingly, by performing the thermal treatment at a temperature higher than the melting point of Sn, Sn in the liquid phase state can react with Zn or Cu as appropriate. With this reaction, the electrical contact material 1 can be obtained that includes the oxide layer 30 on the outermost surface and the metal layer 20 in which the second metal layer 22 is formed on the oxide layer 30 side. The second metal layer 22 is a layer in which the atomic concentration of Cu is sufficiently lower than the atomic concentration of Sn. The shorter the time until the thermal treatment from the end of the plating process is, the easier it is possible to suppress alloying of the coating layer 120. Accordingly, the time until the thermal treatment from the end of the plating process may be preferably within 10 days, within 5 days, or within 2 days, and more preferably within 1 day.

Effects

The electrical contact material 1 according to the embodiment satisfies the condition that, beneath the oxide layer 30, the ratio of the atomic concentration of Cu to the atomic concentration of Sn is less than 1.4. Accordingly, in the electrical contact material 1, a Cu oxide is not likely to be formed in the oxide layer 30. The oxide layer 30 with a smaller amount of Cu oxide can easily ensure the electrical conductivity. Accordingly, even if the oxide layer 30 is present on the outermost surface, the electrical contact material 1 can ensure a favorable electrical connection between the base material 10 and a counterpart material via the electrically-conductive oxide layer 30 and metal layer 20. Accordingly, the electrical contact material 1 can suppress an increase in contact resistance even if contact pressure with the counterpart material is small.

In the electrical contact material manufacturing method according to the embodiment, the coated material 100 is formed in which the base material 110 is coated with the first layer 121 made of metal containing Sn, the second layer 122 made of metal containing Zn, and the third layer 123 made of metal containing Cu in the order from the base material 110 side. At this time, the layers 121, 122, and 123 each having a thickness in a predetermined range are stacked. Then, the coated material 100 is subjected to the thermal treatment at a temperature in a predetermined range. With this measure, the metal layer 20 made of an alloy that contains Sn, Zn, and Cu can be formed on the surface of the base material 10, and thus, beneath the oxide layer 30 formed on the surface of the metal layer 20, the ratio of the atomic concentration of Cu to the atomic concentration of Sn can be set to be less than 1.4.

Test Example 1

An electrical contact material that includes a base material, a metal layer provided on a surface of the base material, and an oxide layer provided on a surface of the metal layer was manufactured. Also, the atomic concentration ratio Sn/Cu of the electrical contact material beneath the oxide layer, and the contact resistance thereof were determined.

<<Manufacturing of Samples>>

By performing electroplating on the surface of the base material, an organic acid Sn plating, which is to configure the first layer, a sulfuric acid Zn plating, which is to configure the second layer, and a pyrophosphoric acid Cu plating, which is to configure the third layer, were obtained in the order from the base material side. The thicknesses of the respective layers are shown in Table 1. As the base material, a coated metal plate was used that was obtained by applying a sulfuric acid copper plating of 0.2 μm to the surface of the metal plate made of Cu. After the manufacturing of the coated material in which the surface of the base material was plated, thermal treatment was performed on the coated material. The conditions of the thermal treatment are shown in Table 1. Note that the retention time of the thermal treatment was set to 3 minutes. The expression "time until thermal treatment" in Table 1 means the time starting from immediately after the end of the plating to a point in time at which the thermal treatment is performed.

TABLE 1

| | Plating condition (thickness) | | | Thermal treatment condition | |
|---|---|---|---|---|---|
| Sample No. | First layer Sn (μm) | Second layer Zn (μm) | Third layer Cu (μm) | Temperature (° C.) | Time until thermal treatment (day) |
| 1-1 | 3.5 | 0.2 | 0.2 | 270 | 2 |
| 1-2 | 3.5 | 0.2 | 0.4 | 270 | 1 |
| 1-3 | 3.5 | 0.2 | 0.2 | 300 | 3 |
| 1-4 | 3.5 | 0.2 | 0.05 | 270 | 2 |
| 1-5 | 3.5 | 0.1 | 0.2 | 270 | 3 |
| 1-6 | 3.5 | 0.6 | 0.2 | 270 | 1 |
| 1-7 | 5.0 | 0.2 | 0.2 | 270 | 14 |
| 1-11 | 3.5 | — | 0.2 | 270 | 3 |
| 1-12 | 3.5 | 0.2 | — | 270 | 2 |
| 1-13 | 3.5 | 0.2 | 0.6 | 270 | 2 |
| 1-14 | 3.5 | 0.8 | 0.2 | 270 | 3 |
| 1-15 | 1.5 | 0.2 | 0.2 | 270 | 1 |
| 1-16 | 2.0 | 0.2 | 0.2 | 300 | 28 |

<<Composition Analysis>>

For each of the manufactured electrical contact material samples, X-ray photoelectron spectrometry is performed to analyze the composition of the outer-most oxide layer. As a result, in the sample Nos. 1-1 to 1-7, the oxide layer contained Zn, Cu, and Sn. Furthermore, the compositions of the layers below the oxide layers of the sample Nos. 1-1 to 1-7 were analyzed using an X-ray fluorescence spectrometer. As a result, it was found that, below each oxide layer, a second metal layer mainly made of Sn was formed, and further below the second metal layer, a first metal layer that contains an intermetallic compound mainly made of $(Cu, Zn)_6Sn_5$ was formed.

<<Oxide Layer>>

For each of the manufactured electrical contact material samples, the thickness of the oxide layer, and the atomic concentrations of the elements of the oxide layer were determined using X-ray photoelectron spectrometry. The thicknesses of the oxide layers, and the atomic concentrations of the elements of the oxide layers are shown in Table 2. Note that the oxide layers contained impurities other than O, Zn, Cu, and Sn, but the impurities are excluded in the table.

<<Beneath Oxide Layer>>

For each of the manufactured electrical contact material samples, the ratio of the atomic concentration of Cu to the atomic concentration of Sn beneath the oxide layer, that is, the atomic concentration ratio Cu/Sn was determined using X-ray photoelectron spectrometry. Note that "beneath the oxide layer" means the range within 0.05 μm from the interface between the oxide layer and the second metal layer to the second metal layer side in terms of sputtering rate of $SiO_2$. The results are shown in Table 2.

<<Second Metal Layer and First Metal Layer>>

For each of the manufactured electrical contact material samples, the thicknesses of the second metal layer and the first metal layer, which are provided below the oxide layer, were determined. The thickness of the second metal layer was obtained using an X-ray fluorescence film thickness meter in the following manner. First, the oxide layer was removed, and the contents of Sn in specific areas of the second metal layer and the first metal layer as a whole were measured using the X-ray fluorescence film thickness meter. Each specific area was set to have a dimension of 0.03 $mm^2$. Then, the second metal layer was removed, and the contents of Sn in the specific areas of the remaining first metal layer were measured using the X-ray fluorescence film thickness meter. The removal of the oxide layer and the removal of the second metal layer were performed through etching using treatment liquid in which sodium hydroxide, P-nitrile phenol, and distilled water were mixed. The oxide layer, and the second metal layer can be removed individually by adjusting the etching time. The thickness of the second metal layer was calculated based on a difference between the measured contents of Sn of the layers. The thickness of the first metal layer was calculated in such a manner that the second metal layer was removed, and then the contents of Sn were measured using the X-ray fluorescence film thickness meter, and were converted into the thickness based on the composition and density of the first metal layer, and the specific areas. The results are shown in Table 2.

<<Contact Resistance>>

A gold-plated spherical indenter with a radius of 1 mm was brought into contact, upon application of a load of 1N, with each of the manufactured electrical contact material samples, and the contact resistance was measured using a four-terminal sensing resistance measurement device. As the contact resistance, an initial resistance and an after-endurance resistance were measured. The initial resistance refers to a contact resistance of a sample that was cooled to a room temperature after having been subjected to the thermal treatment. The after-endurance resistance refers to a contact resistance of the sample that was held at 160° C. for 120 minutes. The results are shown in Table 2.

TABLE 2

| | Oxide layer | | | | | Beneath oxide layer | Second metal layer | First metal layer | Evaluation | |
|---|---|---|---|---|---|---|---|---|---|---|
| Sample No. | Thickness (nm) | O concentration (atom %) | Zn concentration (atom %) | Cu concentration (atom %) | Sn concentration (atom %) | Atomic concentration ratio Cu/Sn | Thickness (μm) | Thickness (μm) | Initial resistance (mΩ) | After endurance resistance (mΩ) |
| 1-1 | 21 | 42.4 | 41.7 | 11.7 | 0.5 | 0.15 | 0.7 | 3.5 | 1.1 | 1.1 |
| 1-2 | 27 | 43.4 | 37.0 | 15.3 | 1.0 | 0.22 | 0.6 | 3.6 | 1.4 | 1.6 |
| 1-3 | 72 | 40.1 | 45.2 | 10.9 | 0.6 | 1.21 | 0.6 | 3.7 | 1.8 | 1.8 |
| 1-4 | 27 | 41.6 | 48.9 | 8.8 | 0.4 | 0.1 | 0.5 | 3.6 | 1.0 | 1.1 |
| 1-5 | 45 | 41.3 | 40.4 | 14.5 | 0.2 | 0.17 | 0.6 | 3.3 | 1.4 | 1.4 |
| 1-6 | 63 | 41.2 | 50.3 | 6.8 | 0.1 | 0.21 | 0.7 | 3.4 | 1.6 | 1.6 |
| 1-7 | 30 | 43.5 | 42.9 | 10.9 | 0.4 | 0.13 | 1.9 | 3.7 | 1.1 | 1.2 |
| 1-11 | 36 | 46.9 | 0 | 21.9 | 29.6 | 0.02 | 0.6 | 3.4 | 5.8 | 6.4 |
| 1-12 | 24 | 43.4 | 51 | 0.9 | 3.9 | 1.72 | 0.5 | 3.6 | 1.6 | 3.4 |
| 1-13 | 99 | 40.6 | 6.8 | 50.7 | 0 | 1.41 | 0.4 | 3.4 | 3.5 | 33.6 |
| 1-14 | 78 | 41.3 | 17.6 | 39.9 | 0 | 4 | 0.5 | 3.5 | 3.1 | 2.2 |
| 1-15 | 42 | 41.5 | 41.9 | 16.6 | 0 | 3.31 | 0 | 2.2 | 20.1 | 64.0 |
| 1-16 | 54 | 34.0 | 13.3 | 48.9 | 0.6 | 1.52 | 0.2 | 2.6 | 1.7 | 3.0 |

As shown in Tables 1 and 2, the sample Nos. 1-1 to 1-7 satisfy the condition that the atomic concentration ratio Cu/Sn is less than 1.4. The reason why the sample Nos. 1-1 to 1-7 satisfy the atomic concentration ratio Cu/Sn of less than 1.4 is considered to be that, in the process of manufacturing the electrical contact material, the plating processing was performed so that the first layer, the second layer, and the third layer, in the order from the base material side, each have a specific thickness, and then the thermal treatment was performed at 270° C. or 300° C. The specific thickness of the first layer is from 0.5 to 5 μm inclusive, the specific thickness of the second layer is from 0.1 to 0.6 μm inclusive, and the specific thickness of the third layer is from 0.05 to 0.4 μm inclusive.

The coated material obtained by coating the base material with the coating layers constituted by the first layer, the second layer, and the third layer undergoes alloying reaction over time. On the other hand, when thermal treatment is performed on the coated material, an oxide layer is formed on the surface of the coated material. At this time, it is conceivable that, as a result of each layer having a specific thickness and the thermal treatment being performed at a specific temperature, the following phenomena occurred. As a result of the thermal treatment being performed at the above-described specific temperature, Sn entered into a liquid phase state. As a result of the Sn-plated first layer having the above-described specific thickness, Sn in the first layer entered into a liquid phase state, and diffused to the oxide layer side. It is conceivable that, with the Sn, an Sn oxide was formed in the oxide layer, and the second metal layer mainly made of Sn was formed beneath the oxide layer. Furthermore, as a result of the Zn-plated second layer having the above-described specific thickness, it is conceivable that, similar to Sn, Zn in the second layer diffused to the oxide layer side, and a Zn oxide was formed in the oxide layer. However, it is conceivable that, at the above-described specific temperature, Zn was not likely to enter into a liquid phase state, and the second metal layer contained, if at all, a small amount of Zn. On the other hand, it is conceivable that, as a result of the Cu-plated third layer having the above-described specific thickness, Cu in the third layer was not likely to diffuse to the oxide layer side, the second metal layer contained, if at all, a small amount of Cu, and a small amount of Cu oxide was formed in the oxide layer. Accordingly, it is conceivable that, in the sample Nos. 1-1 to 1-7, the first metal layer that includes an intermetallic compound mainly made of $(Cu, Zn)_6Sn_5$ was formed on the surface of the base material, and an oxide layer that includes constituent elements of the plated layers was formed on the outermost surface. Note that $(Cu, Zn)_6Sn_5$ is substantially $Cu_6Sn_5$, but means that part of Cu is substituted by Zn. Here, it is conceivable that, in the sample Nos. 1-1 to 1-7, due to Sn in the liquid phase state, the second metal layer mainly made of Sn was formed between the first metal layer and the oxide layer, and the atomic concentration ratio Cu/Sn beneath the oxide layer was reduced to 0.22 or less.

As a result of the atomic concentration ratio Cu/Sn beneath the oxide layer being less than 1.4, a Cu oxide was not likely to be formed in the oxide layer. The oxide layer with a small amount of copper oxide has a low resistance, and can easily ensure the electrical conductivity. Therefore, it is conceivable that the sample Nos. 1-1 to 1-7 had an initial resistance and an after-endurance resistance that are substantially the same even in a state in which an oxide layer was provided on the surface of the metal layer, and thus could suppress an increase in the contact resistance.

On the other hand, the sample Nos. 1-15 and 1-16 has a large atomic concentration ratio Cu/Sn of 1.4 or more. The reason why the sample Nos. 1-15 and 1-16 has such a large atomic concentration ratio Cu/Sn is considered to be that, in the process of manufacturing the electrical contact material, the first layer had a small thickness. It is conceivable that, as a result of the first layer having a small thickness, Sn in the first layer was not likely to diffuse toward the oxide layer, and the amount of Cu beneath the oxide layer was increased relatively. As a result of the atomic concentration ratio Cu/Sn beneath the oxide layer being large, namely, 1.4 or more, a Cu oxide was likely to be formed in the oxide layer. Accordingly, it is conceivable that the sample Nos. 1-15 and 1-16 had the increased after-endurance resistance relative to the initial resistance. Particularly, in the sample No. 1-15 that includes a thinner first layer, no second metal layer was formed below the oxide layer and the oxide layer did not contain Sn. Accordingly, the sample No. 1-15 also had an increased initial resistance.

The sample No. 1-14 has the significantly large atomic concentration ratio Cu/Sn of 4. The reason why the sample No. 1-14 has such a large atomic concentration ratio is considered to be that, in the process of manufacturing the electrical contact material, the second layer had a large thickness. It is conceivable that, as a result of the second layer having a large thickness, Sn in the first layer was not likely to diffuse toward the oxide layer and the amount of Cu beneath the oxide layer was increased relatively. Actually, the oxide layer did not contain Sn. Therefore, the sample No. 1-14 also had an increased initial resistance.

The sample No. 1-12 has the large atomic concentration ratio Cu/Sn of 1.72. The reason why the sample No. 1-12 has such a large atomic concentration ratio is considered to be that, in the process of manufacturing the electrical contact material, no third layer was provided. It is conceivable that, as a result of no third layer being provided, there was no element to react with Sn in the first layer, and Cu, which is a constituent element of the base material, was likely to diffuse toward the oxide layer, and beneath the oxide layer, the amount of Cu derived from the base material was increased. Accordingly, it is conceivable that the sample No. 1-12 had the increased after-endurance resistance relative to the initial resistance.

The sample No. 1-13 has the large atomic concentration ratio Cu/Sn of 1.41. The reason why the sample No. 1-13 has such a large atomic concentration ratio is considered to be that, in the process of manufacturing the electrical contact material, the third layer had a large thickness. It is conceivable that, as a result of the third layer having a large thickness, Cu in the third layer was likely to diffuse toward the oxide layer and the amount of Sn beneath the oxide layer was reduced relatively. As a result of the atomic concentration ratio Cu/Sn beneath the oxide layer being large, namely, 1.4 or more, a Cu oxide was likely to be formed in the oxide layer. Actually, the atomic concentration of Cu in the oxide layer was significantly large, namely, 50.7 atom %. Therefore, it is conceivable that the sample No. 1-13 had an increased after-endurance resistance relative to the initial resistance. Furthermore, in the sample No. 1-13, the oxide layer did not contain Sn. Therefore, the sample No. 1-13 also had an increased initial resistance.

The sample No. 1-11 satisfied the condition that the atomic concentration ratio Cu/Sn is less than 1.4. However, the initial resistance of the sample No. 1-11 was large and the after-endurance resistance thereof with respect to the initial resistance was also large. The reason why the sample No. 1-11 has such large contact resistances is considered to be that, in the process of manufacturing the electrical contact material, no second layer was provided. It is conceivable that, as a result of no second layer being provided, the oxide layer did not contain Zn, and the resistance of the oxide layer was increased.

LIST OF REFERENCE NUMERALS

1 Electrical contact material
10 Base material
20 Metal layer
  21 First metal layer
  22 Second metal layer
30 Oxide layer
100 Coated material
110 Base material
120 Coating layer
  121 First layer
  122 Second layer
  123 Third layer
200 Terminal fitting
210 Wire barrel portion
  220 Insulation barrel portion
  230 Fitting portion
  231 Box portion
  232, 233 Elastic piece
300 Electrical wire
  310 Conductor
  320 Insulating layer

What is claimed is:

1. An electrical contact material comprising:

a base material made of metal;

a metal layer provided on a surface of the base material; and an oxide layer provided on a surface of the metal layer, wherein:

the metal layer is made of metal that contains zinc, copper, and tin, the oxide layer is made of an oxide that contains zinc, copper, and tin, beneath the oxide layer, a ratio of the atomic concentration of copper to the atomic concentration of tin is less than 1.4, and in the oxide layer, the atomic concentration of oxygen is more than 0 atom % and is equal to or less than 70 atom %, the atomic concentration of zinc is more than 0 atom % and is equal to or less than 70 atom %, the atomic concentration of copper is more than 0 atom % and is equal to or less than 30 atom %, and the atomic concentration of tin is more than 0 atom % and is equal to or less than 30 atom %.

2. The electrical contact material according to claim 1, wherein the oxide layer has an average thickness of 1 nm to 1000 nm inclusive.

3. The electrical contact material according to claim 1, wherein the metal layer includes:

a first metal layer provided on the base material side; and a second metal layer provided on the oxide layer side, and the first metal layer is made of an alloy that contains two or more types of elements selected from a group consisting of zinc, copper, and tin, and the second metal layer is made of tin or a tin alloy.

4. The electrical contact material according to claim 3, wherein the first metal layer has an average thickness of 0.1 μm to 5 μm inclusive.

5. The electrical contact material according to claim 3, wherein the second metal layer has an average thickness of 0.1 μm to 5 μm inclusive.

6. A terminal fitting made of the electrical contact material according to claim 1.

7. A connector comprising the terminal fitting according to claim 6.

8. A wire harness comprising:

an electrical wire; and the connector according to claim 7 that is attached to the electrical wire.

9. A wire harness comprising:

an electrical wire; and the terminal fitting according to claim 6 that is attached to the electrical wire.

10. An electrical contact material manufacturing method, comprising:

a step of manufacturing a coated material by plating a first layer, a second layer, and a third layer on at least a part of a surface of a base material in the order from the surface of the base material; and a step of subjecting the coated material to thermal treatment under oxygen atmosphere at a temperature of 232° C. to 500° C. inclusive, wherein, in the step of manufacturing the coated material, the first layer is made of metal that contains tin, the second layer is made of metal that contains zinc, the third layer is made of metal that contains copper, the first layer has a thickness of 3.5 μm to 5 μm inclusive, the second layer has a thickness of 0.1 μm to 0.6 μm inclusive, and the third layer has a thickness of 0.05 μm to 0.4 μm inclusive, and wherein, an oxide layer is formed on a surface of the coated material, and in the oxide layer, the atomic concentration of oxygen is more than 0 atom % and is equal to or less than 70 atom %, the atomic concentration of zinc is more than 0 atom % and is equal to or less than 70 atom %, the atomic concentration of copper is more than 0 atom % and is equal to or less than 30 atom %, and the atomic concentration of tin is more than 0 atom % and is equal to or less than 30 atom %.

* * * * *